US007182273B2

(12) United States Patent
Proulx, Jr.

(10) Patent No.: US 7,182,273 B2
(45) Date of Patent: Feb. 27, 2007

(54) SPRAYING SYSTEM WITH AUTOMATED NOZZLE CLEANING DEVICE

(75) Inventor: David Proulx, Jr., Franklin, NH (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 10/735,365

(22) Filed: Dec. 12, 2003

(65) Prior Publication Data

US 2004/0195353 A1 Oct. 7, 2004

Related U.S. Application Data

(60) Provisional application No. 60/433,663, filed on Dec. 16, 2002.

(51) Int. Cl.
*B05B 15/02* (2006.01)

(52) U.S. Cl. ..... 239/110; 239/114; 239/117

(58) Field of Classification Search ..... 239/110, 239/114–117, 123
See application file for complete search history.

(56) References Cited

U.S. PATENT DOCUMENTS

| | | | | |
|---|---|---|---|---|
| 2,884,203 | A | 4/1959 | Broughton | |
| 3,228,611 | A | 1/1966 | Russell | |
| 4,404,507 | A * | 9/1983 | Dean et al. | 318/570 |
| 4,867,870 | A * | 9/1989 | Kettlety et al. | 210/139 |
| 5,048,282 | A * | 9/1991 | Hunt et al. | 57/267 |
| 5,664,731 | A | 9/1997 | Lemetyinen et al. | |
| 5,746,250 | A * | 5/1998 | Wick | 137/624.11 |
| 6,073,861 | A * | 6/2000 | Wright et al. | 239/114 |

* cited by examiner

*Primary Examiner*—Christopher Kim
(74) *Attorney, Agent, or Firm*—Leydig, Voit & Mayer, Ltd.

(57) ABSTRACT

A shower header type spray device has a motorized cleaning brush on a rotary shaft mounted therein for cleaning inlet apertures of its spray nozzles. The brush shaft is supported to impart axial movement when it is rotated, and has a sealing valve attached thereon such that when the brush is rotated by the motor in a cleaning operation the valve is opened to allow discharge of liquid with debris brushed off the nozzle inlets. The motor is activated for a cleaning operation from either a local controller or a centralized controller that controls multiple spray devices.

2 Claims, 5 Drawing Sheets

SPRAYING SYSTEM WITH AUTOMATED NOZZLE CLEANING DEVICE

CROSS-REFERENCE TO RELATED PATENT APPLICATIONS

This application claims the priority of U.S. provisional application Ser. No. 60/433,663, filed Dec. 16, 2002.

FIELD OF THE INVENTION

The present invention relates generally to liquid spraying systems, and more particularly to shower header-type spray devices which are particularly adapted for spraying cleaning or washing fluid onto processing rollers in pulp and paper mills.

BACKGROUND OF THE INVENTION

Shower header-type spray devices commonly are used for periodically cleaning processing rollers in pulp and paper mills. Such spray devices include an elongated header having a plurality of laterally spaced, downwardly directed liquid spray nozzles which are adapted for directing a curtain of water or other cleaning fluid onto a processing roller during periodic or other required cleaning cycles. Since a single processing machine can include a multiplicity of such header-type shower spraying systems, significant cleaning fluid is used. To conserve cleaning fluid, it is common to collect the cleaning fluid during the course of a cleaning cycle, filter out the debris and contaminants from the fluid during a recycling process, and to reuse the cleaning fluid. Nevertheless, some solid particles and matter can pass through the filtering system which over time can plug or impede liquid flow through one or more of the nozzles of the header.

It is known for shower headers to include an elongated cleaning brush which can be rotated to cause the brush bristles to move across and clean the inlet apertures of the spray nozzles in the header. Heretofore, each time one or more of the spray nozzles becomes clogged, or during the regular cleaning cycles, it is necessary for an operator to go to the individual header and manually turn the cleaning brush of the header. Due to the multiplicity of such headers, which can be ten or more per machine, such cleaning process can be time consuming and tedious, requiring significant shut down in operation of the machine. It also necessitates that the operator go to each shower header, which can create a safety hazard to the operator due to wet and slippery surroundings.

OBJECTS AND SUMMARY OF THE INVENTION

It is an object of the present invention to provide a shower header type spray device in which the spray nozzles thereof are adapted for easier and more efficient cleaning. A related object is to provide such a show header-type spray device adapted to substantially minimize costly labor in connection with periodic or other required cleaning of the spray nozzles of the spray device.

Another object is to provide a shower header spray device as characterized above which can be more safely operated. In this regard, a related object is to provide such a shower header spray device that eliminates the necessity for an operator to go to or be in the vicinity of the spray device during nozzle cleaning operations.

A further object is to provide a shower header spray device of the foregoing type which can be automatically operated during clean out operations.

Still another object is to provide a spraying system that comprises a plurality of shower header spray devices of the foregoing type, the cleaning cycles of which can be controlled from a central control station.

Yet a further object is to provide a shower header brush drive which is adapted for easy retrofitting assembly on existing shower headers in the field.

Other objects and advantages of the invention will become apparent upon reading the following detailed description and upon reference to the drawings, in which:

Figure 1:
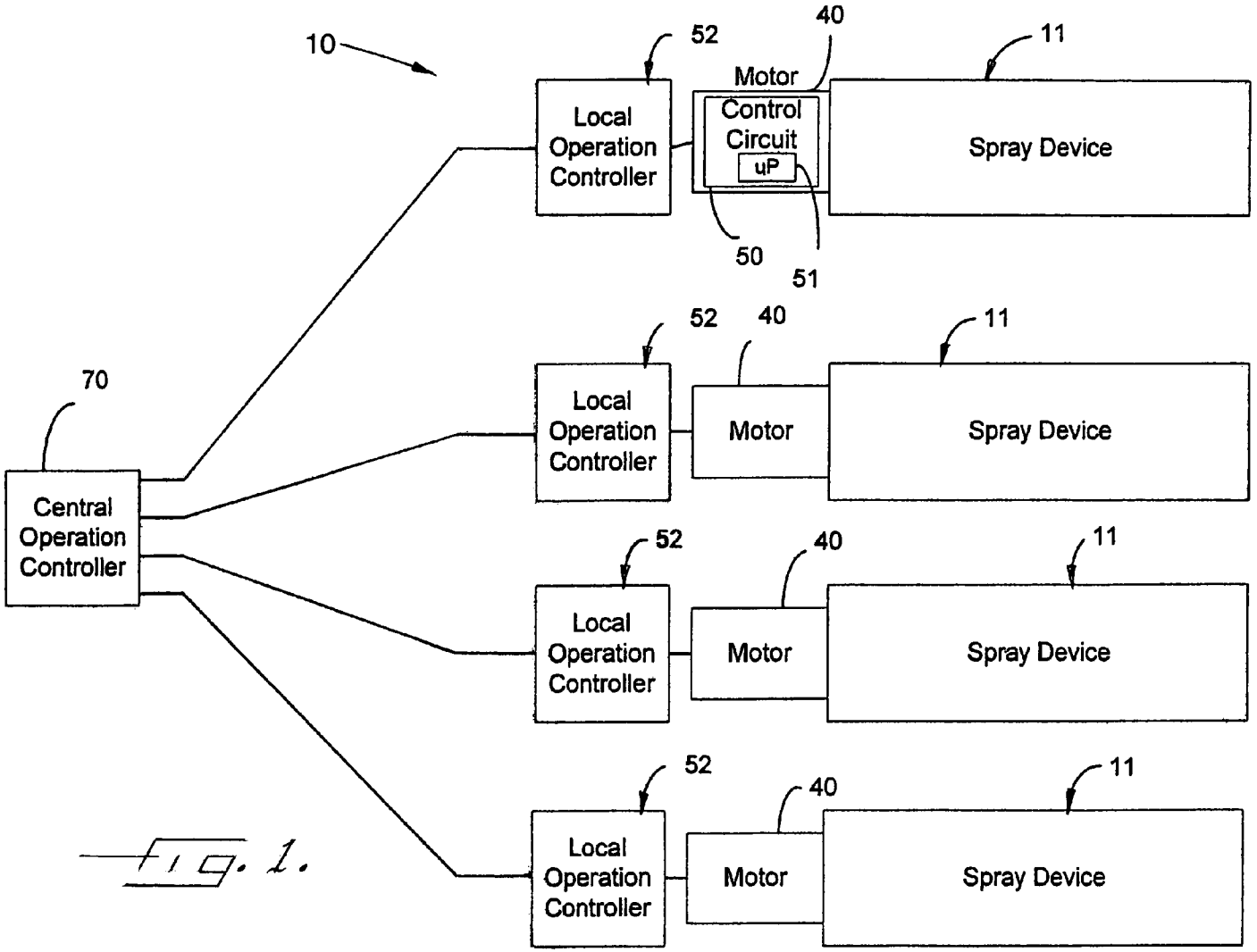
FIG. 1 is a diagrammatic depiction of an illustrative spraying system comprising a plurality of shower header-type spray devices in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative washing system 10 which has particular utility in pulp and paper processing and like. The illustrative spraying system 10 which includes a plurality of shower header-type spray devices 11 in accordance with the invention, each of which is adapted for spraying a cleaning fluid onto a respective roller 21 (FIG. 2) of a pulp or paper-processing machine. While the illustrated spraying system 10 is described in connection with the direction of cleaning fluid in pulp or processing machines, it will be understood that the spraying system, including the individual header-type spray devices thereof, can be used for other liquid or spraying uses.

Figure 2:
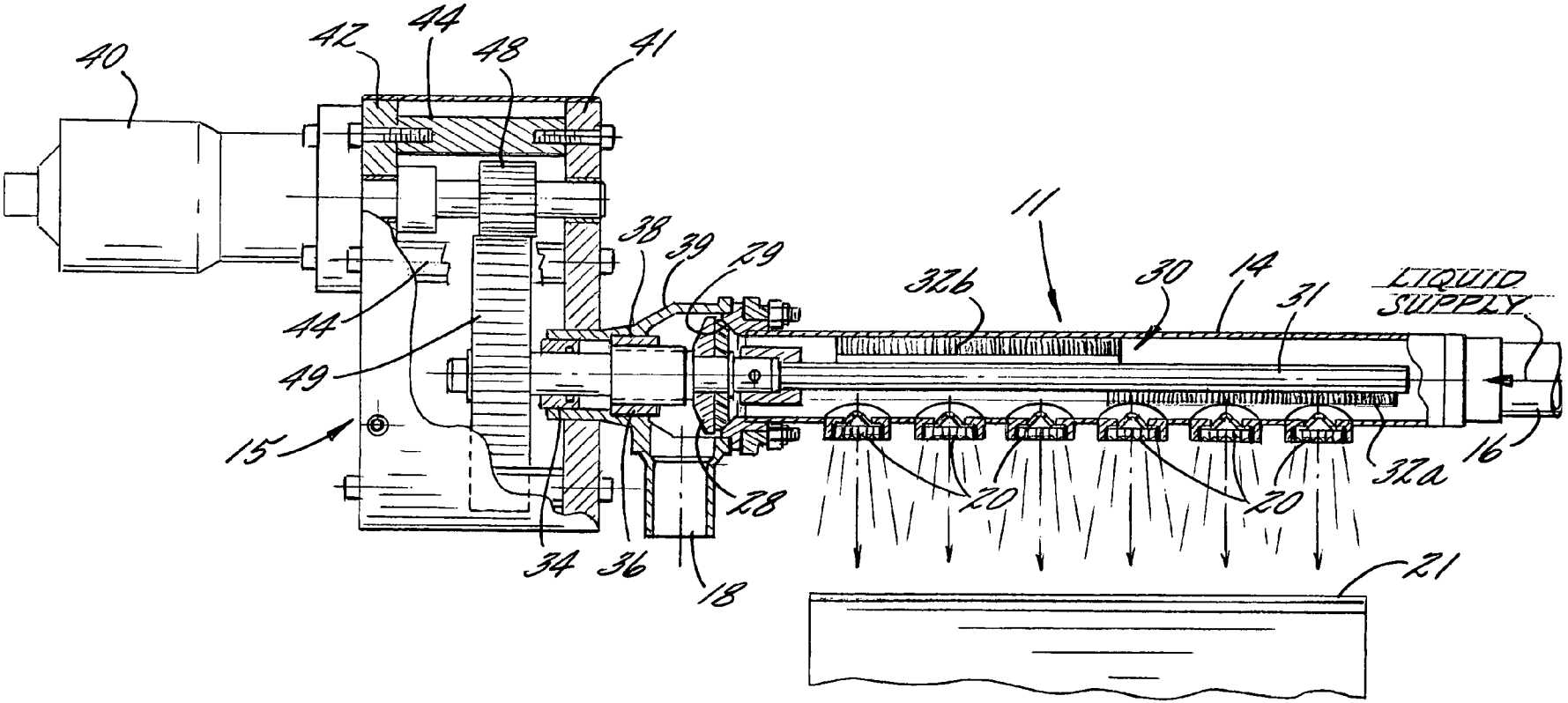
FIG. 2 is a longitudinal, vertical section of one of the illustrated shower header spray devices with a liquid control valve thereof in a closed spraying condition.
Figure 3:
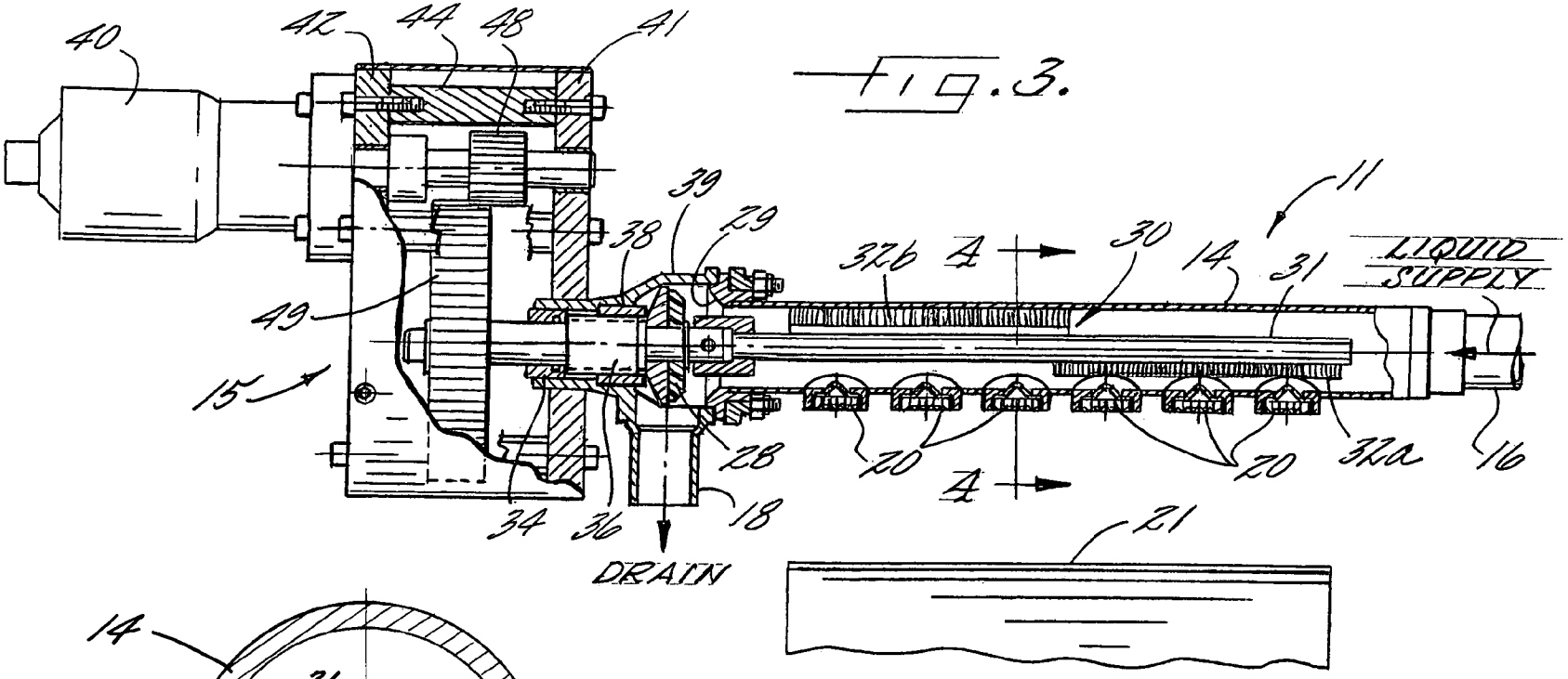
FIG. 3 is a longitudinal, vertical section, similar to FIG. 2, showing the liquid control valve in an open nozzle cleaning position.
Figure 4:
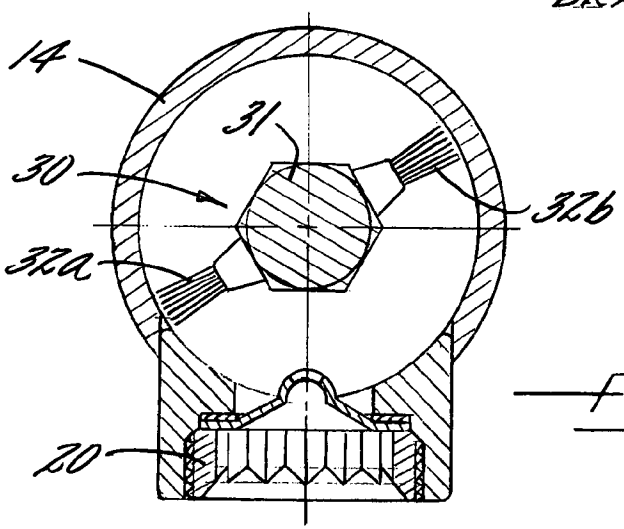
FIG. 4 is an enlarged vertical section taken in the plane of line 4—4 in FIG. 2.
Figure 5:
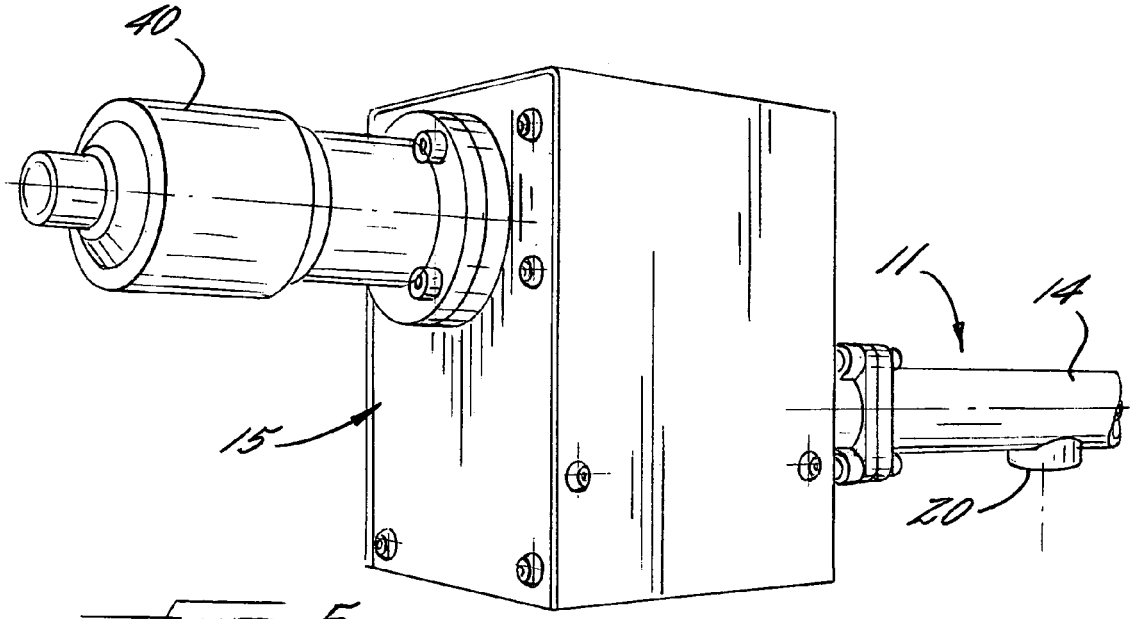
FIG. 5 is an enlarged perspective of the cleaning brush drive for the illustrated shower header spray device.
Figure 6:
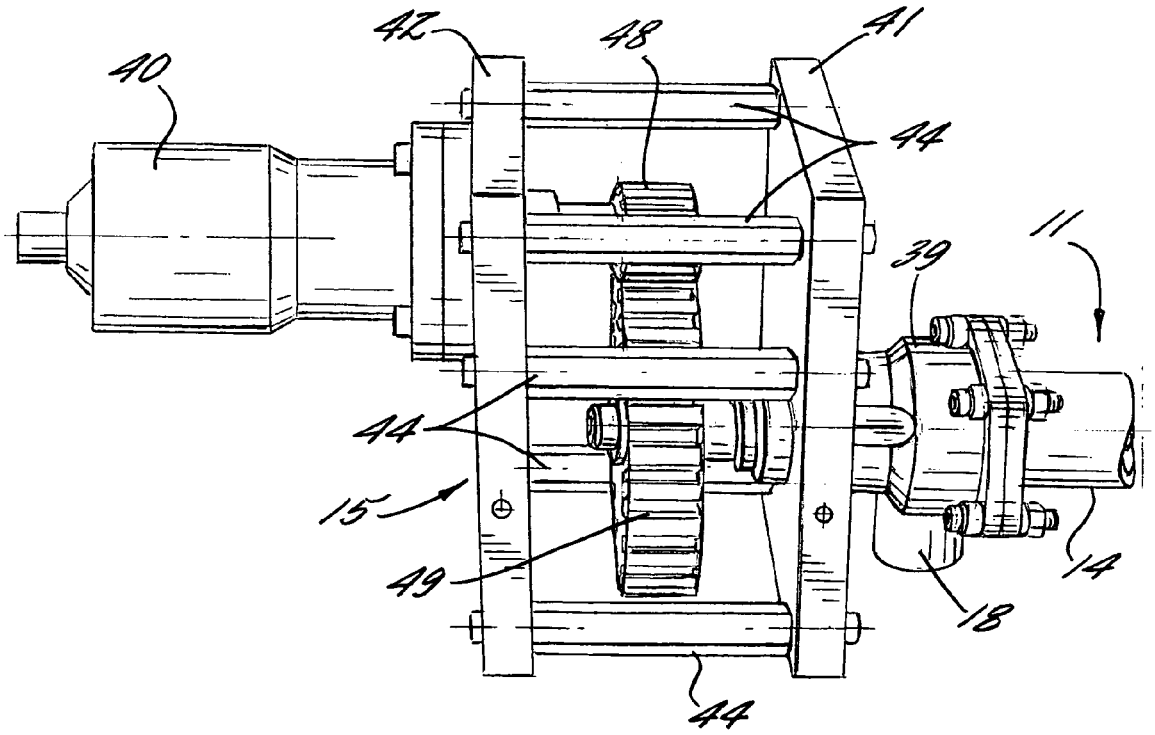
FIG. 6 is a side elevational view of the cleaning brush drive with a cover thereof removed.

Each illustrated shower header-type spray device 11, as depicted in FIG. 2, includes an elongated generally tubular-configured header 14 supported in cantilever relation from a support frame 15. Each header 14 has an upstream end connected to a pressurized liquid supply 16, a drain pipe 18 communicating with a downstream end of the header 14, in this case extending in radial downward relation to the header 14, and a plurality of spray nozzles 20 mounted at uniformly spaced intervals laterally along the header 14. The spray nozzles 20 may be of a known type, such as fan spray nozzles commercially available from Spraying Systems Co., assignee of the present application. Such nozzles are effective for discharging a respective fan spray pattern in partially overlapping relation for uniform liquid distribution onto a processing roller 21 or the like disposed below the header 14. The spray device 14 in this case includes a valve member 28, which is positionable against a valve seat 29 at the downstream end of the header 14 for sealing the downstream end of the header during a liquid spraying operation. Hence, pressurized liquid introduced into the inlet end of the header 14 is directed through the header and discharges through the plurality of spray nozzles 20.

As indicated above, shower header spray devices of the foregoing type have particular utility in cleaning pulp and paper particles from the rollers of processing machines in pulp and paper mills. To conserve washing fluid, it is customary to collect and recycle the cleaning fluids used during roller cleaning operations. Nevertheless, some particulate matter can be recirculated with the cleaning fluid, which over time can clog one or more of the spray nozzles, or otherwise necessitate periodic cleaning of the spray nozzles of the header. Heretofore, it has been necessary to manually effect cleaning of the spray nozzles of each spray header individually. Because of the multiplicity of processing rollers in each machine, this can be a tedious and time-consuming procedure that can significantly interrupt operation and efficiency of the machine.

In accordance with the invention, each shower header spray device has a remotely controlled nozzle cleaning apparatus that can be selectively or automatically operated for cleaning the spray nozzles of the headers, without necessity for an operator to manually effect the cleaning process or even be in the vicinity of the header. In the illustrated embodiment, each header 14 has a respective cleaning brush 30 housed within the header which includes a rotatable shaft 31 having a plurality of brush segments 32*a*, 32*b* each comprising radial cleaning bristles. The brush shaft 31 is supported at opposite ends in appropriate bearings 34 for rotational and axial movement with respect to the header 14.

The brush segments 32*a*, 32*b* preferably are oriented in diametrically opposed relation to the shaft 31 such that as an incident to rotation of the shaft 31, the brush segments 32*a*, 32*b* successively clean respective numbers of the laterally spaced spray nozzles 20. In the illustrative embodiment, the brush segment 32*a* is operable for cleaning three laterally spaced spray nozzles 20 adjacent an upstream end of the header 14, while the brush segment 32*b* is operable for cleaning the three laterally spaced spray nozzles 20 adjacent a downstream end of the header 14.

For imparting simultaneous axial movement of the brush shaft 31 as an incident to rotation thereof, a downstream end of the brush shaft 31 has a threaded pinion 36 which is disposed within a nut 38 fixed within a downstream housing section 39 of the header 14. Hence, as an incident to the rotation of the shaft 31 in one direction, the pinion 36 moves axially to the left in the nut 38, causing the brush segments 32*a*, 32*b* to move with a combination rotary and axial movement in sweeping fashion across the inlet ends of the nozzles 20 such that the bristles move any debris or solid material that is encumbering or clogging the passage of cleaning fluid to the nozzles. The valve member 28 in this case is mounted on a downstream end of the shaft 31, such that such rotation of the shaft, which advances the brush 30 in a downstream direction, simultaneously moves the valve member 28 to an open position away from the valve seat 29, allowing pressurized liquid from the supply liquid to carry removed debris through the header 14 and out the discharge drain 18. Rotational movement of the shaft in an opposite direction causes the brush segments 32*a*, 32*b* to rotate and axially move in an opposite sweeping fashion across the nozzles 20 until the valve member 28 is seated with the valve seat 29, closing the header 14 from the drain 18, thereby enabling the header to resume a spraying.

In carrying out the invention, for permitting remote and/or automatic rotation of the cleaning brush 30 during cleaning operations, a drive motor 40 is mounted on the support frame 15 and is operatively connected to the cleaning brush shaft for effecting rotation of the cleaning brush. The support frame 15 in this case comprises a pair of laterally spaced plates 41, 42 connected by connecting columns and bolts 44. The header 14 is mounted in outwardly extending relation to one plate 41 while the drive motor 40 is bolted to the opposite from plate 42. The motor 40 in this case has an output shaft which carries a drive pinion 48, which is engageable with a relatively larger diameter drive gear 49 mounted on an upstream end of the brush shaft 31 for enhanced drive torque. The pinion and drive gears 48, 49 are sufficiently wide in the axial direction so as to permit limited longitudinal movement of the gear 49 relative to the pinion with the brush shaft 31 as an incident to the brush shaft being rotatably driven.

In further keeping with the invention, the control of the movements of the drive motor 40 during a cleaning operation and the control of the sequence of steps in the operation are computerized to provide process automation. In a preferred embodiment, the motor 40 is a "smart" motor in the sense that the control electronics 50 (FIG. 1), which includes a microprocessor 51, for controlling the movements of the motor is located inside the housing of the motor. Suitable motors of such design are available, for example, from Oden Control AB in Sweden. The microprocessor in the motor 40 is programmed for pre-defined rotational directions, open and close positions, acceleration speed, rational speed and torque, etc.

Figure 7:
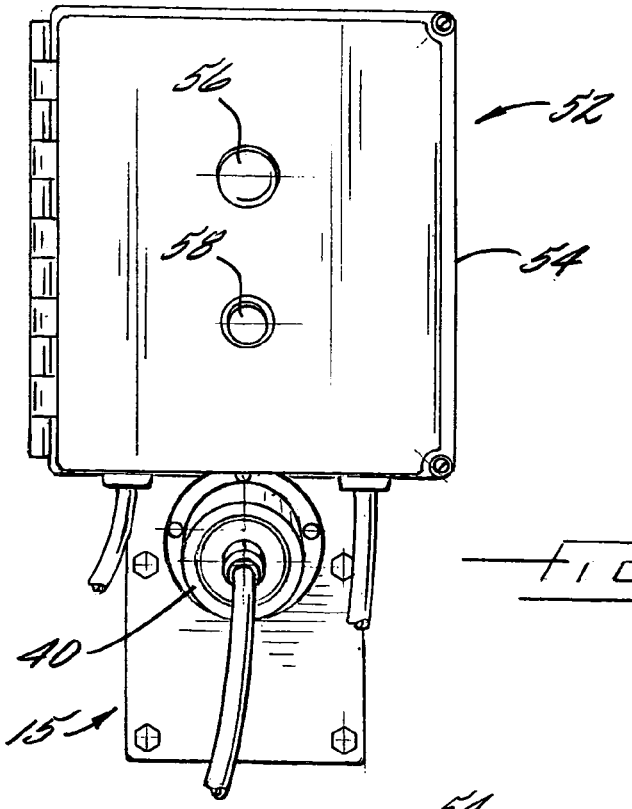
FIG. 7 is a front view of a local operation controller that controls the motor to carry out a cleaning operation.

To control the operation of the motor to carry out the cleaning operation, external control signals are transmitted to the motor. In a preferred embodiment, each motor 40 has a local operation controller 52 mounted adjacent to it. As shown in FIG. 7, the housing 54 of the local operation controller 52 has two buttons 56 and 58 that an operator uses for initiating a cleaning operation to clean the spray device connected to the motor 40. The button 56 on the top is a push-pull type "power-on" button for powering the controller 52 and the motor 40. Power is supplied to the controller 52, which in turn connects the power to the motor 40, when the operator pulls the button 56 out to an "on" position. The button 56 also serves as an emergency-stop button that the operator can push down to cut the power and terminate the operation. The lower button 58 is a "Start" button of an illuminated type. The automated cleaning operation is triggered when the operator presses the Start button 58 after the controller 52 and the motor 40 are powered up. The button 58 also serves as a "ready" indicator, as its light is turned on when the cleaning operation is completed and the spray device is ready for use.

Figure 8:
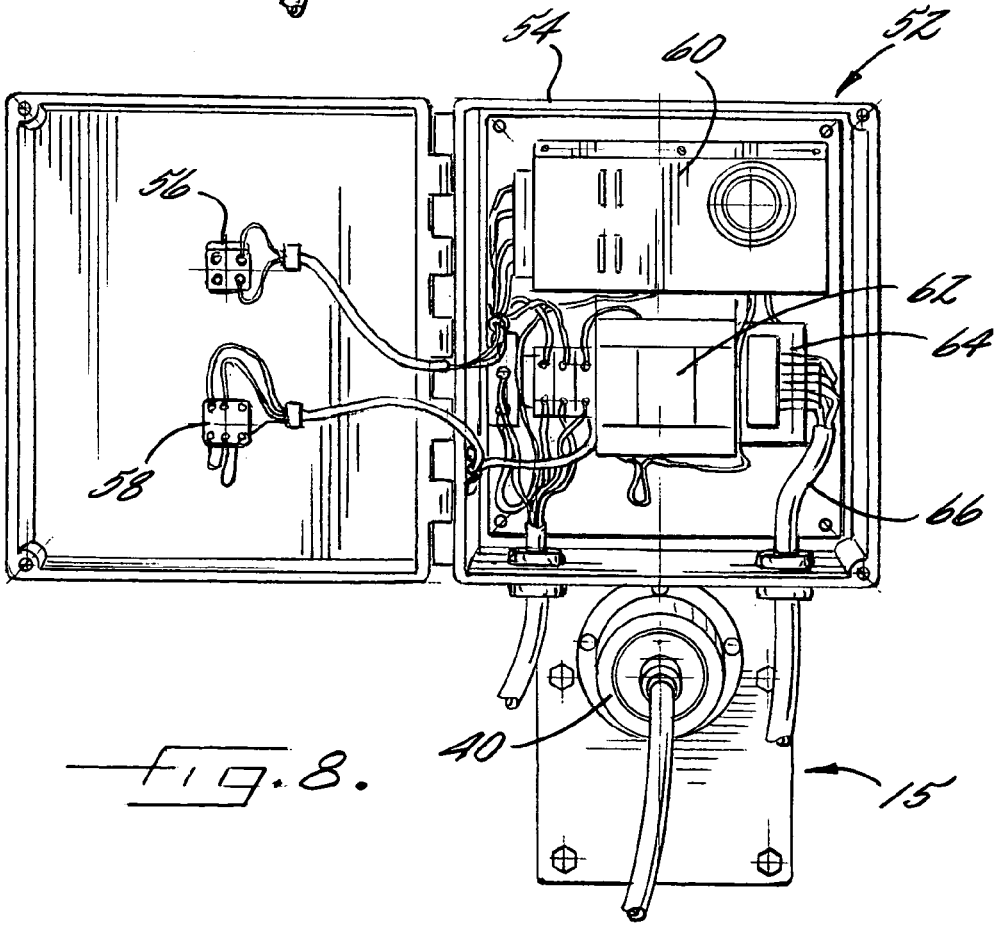
FIG. 8 is a front view of the local operation controller with a front panel opened to reveal components inside the controller.

The local operation controller 52 interacts with the control circuit of the motor 40 to carry out the cleaning operation. As shown in FIG. 8, the controller 52 includes a power supply 60 and a programmable logic circuit (PLC) 62 that contains the control logic (i.e., computer-executable instructions) for the cleaning operation. The PLC 62 is connected to the motor 40 via a printed circuit (PC) connector board 64 and a cable 66. The cable 66 includes conductors for carrying power to the motor, input and out signal lines, and communication lines according to the RS232 standard between the PLC 62 and the motor control circuit 50.

To start a cleaning operation, the operator presses the Start button 58 on the housing of the controller 52 to send a start signal to the PLC 62. Alternatively, a start signal may be generated and sent to the PLC by another controller, such as a central operation controller as will be described in greater detail below. In response to the start signal, the control program in the PLC 62 sends a command to the motor 40 to move to the full-open position. Responding to this command, the control circuit in the motor 40 moves the motor to drive the brush shaft 31 for several revolutions repeatedly, such as three revolutions in one direction, which causes the brush segments to move over the inlet of the spray nozzles in sweeping fashion from the combined rotational and axial movement of the brush shaft, simultaneously moving the sealing member 28 away from the valve seat 29. As soon as the seal at the valve seat is opened, liquid pressure drops below the pressure required to direct liquid through the nozzles 20 so the liquid is diverted through the drain 18, flushing any debris that is cleaned from the nozzles 20 out the drain 18.

After waiting for a programmed time-out period to allow the spray device to be adequately flushed, the PLC 62 sends another control command to the motor 40 to move back to the closed position. In response, the motor 40 reverses its rotational direction, causing the brush shaft 31 to rotate in an opposite direction for a similar number of revolutions, sweeping the nozzles 20 in the opposite direction, until the valve member 28 is reseated on the seat 29. After another time-out period, the PLC 62 generates a "ready" signal by turning on an output line connected to the light of the Start button 58 to illuminate the button to indicate that the cleaning process is completed.

To enable a greater level of automation and operational flexibility, in an alternative embodiment the local operation controllers 52 of the drive motors 40 are connected to a central operation controller 70, as illustrated in FIG. 1. The central operation controller 70 controls the power on/off states of the local controllers 52 and generates start signals to the respective local controllers to start the cleaning operations of the corresponding spray devices 11. When the cleaning operation of a spray device 11 is completed, the local controller 52 of that device transmits a ready signal to the central controller 70. Using a central controller allows the cleaning operations to be controlled remotely. It removes the need for the operator to be physically on the floor of the spray devices, thereby providing greater operational safety and convenience. It also provides greater control flexibility, as the central controller 70 can be programmed to carry out cleaning operations of the individual spraying devices according to a desired schedule.

It will be understood by one skilled in the art that the cleaning brush drive of the present invention may be adapted for convenient retrofitting of shower header-type spray devices in the field. The large reduction gear 49 can be mounted on the downstream end of the brush shaft 31, and the drive motor 40 mounted on the header frame or valve housing, without significant rework. It will be seen that the drive motor is sufficiently small that it can be mounted on the header without interfering in the walkway along the machine. Again, the drive motors may be operated from respective individual controls, or from a central controller.

What is claimed is:

1. A liquid spraying system comprising:

a plurality of shower header spray devices, said spray devices each having an elongated spray header having a plurality of laterally spaced liquid spray nozzles, an elongated cleaning brush having a rotatable brush shaft housed in the spray header for cleaning inlet apertures of the liquid spray nozzles, said brush shaft being supported to impart simultaneous axial movement of the brush shaft as an incident to rotation thereof, a drain opening in communication with a downstream end of the spray header, a valve member mounted on said brush shaft for sealing the spray header from the drain opening, a motor operatively connected to the brush shaft for rotating the brush shaft to cause the brush shaft to move with a combined rotary and axial movement such that the cleaning brush moves in a rotating and sweeping fashion across the inlet apertures of the spray nozzles, said motor having a microprocessor-based control circuit programmed for driving the brush shaft to execute a cleaning operation, a plurality of local operation controllers, said local operation controllers each being connected to an associated spray device for transmitting control signals to the control circuit of the motor of the associated spray device to control said motor in executing a cleaning operation on said associated spray device, each said local operation controller including a start button for sending a trigger signal to trigger said each local operation controller to execute a cleaning operation on an associated spray device, a central operation controller connected to each of the local operation controllers and being operable to send control signals to each local operation controller, and said microprocessor based control circuit for each motor being programmed to rotate the brush shaft a pre-determined number of turns in one rotary direction in response to a first control signal from the local operation controller for cleaning the inlet apertures and allowing discharge of liquid and debris removed by the cleaning brush from the inlet apertures to discharge through the drain opening and to rotate the brush shaft a pre-determined number of turns in an opposite rotary direction in response to a second control signal from the local operation controller to return said valve member to a position closing said drain opening.

2. A liquid spraying system comprising:

a plurality of shower header spray devices, said spray devices each having an elongated spray header having a plurality of laterally spaced liquid spray nozzles, an elongated cleaning brush having a rotatable brush shaft housed in the spray header for cleaning inlet apertures of the liquid spray nozzles, said brush shaft being supported to impart simultaneous axial movement of the brush shaft as an incident to rotation thereof, a drain opening in communication with a downstream end of the spray header, a valve member mounted on said brush shaft for sealing the spray header from the drain opening, a motor operatively connected to the brush shaft for rotating the brush shaft to cause the brush shaft to move with a combined rotary and axial movement such that the cleaning brush moves in a rotating and sweeping fashion across the inlet apertures of the spray nozzles, said motor having a microprocessor-based control circuit programmed for driving the brush shaft to execute a cleaning operation, a plurality of local operation controllers, said local operation controllers each being connected to an associated spray device for transmitting control signals to the control circuit of the motor of the associated spray device to control said motor in executing a cleaning operation on said associated spray device, each said local operation controller including a signaling device for indicating completion of a cleaning operation, a central operation controller connected to each of the local operation controllers and being operable to send control signals to each local operation controller, and said microprocessor based control circuit for each motor being programmed to rotate the brush shaft a pre-determined number of turns in one rotary direction in response to a first control signal from the local operation controller for cleaning the inlet apertures and allowing discharge of liquid and debris removed by the cleaning brush from the inlet apertures to discharge through the drain opening and to rotate the brush shaft a pre-determined number of turns in an opposite rotary direction in response to a second control signal from the local operation controller to return said valve member to a position closing said drain opening.

* * * * *